US005794413A

United States Patent [19]

Draghetti

[11] Patent Number: 5,794,413

[45] Date of Patent: Aug. 18, 1998

[54] PRODUCT OVERWRAPPING METHOD

[75] Inventor: Fiorenzo Draghetti, Medicina, Italy

[73] Assignee: G.D Societa' per Azioni, Bologna, Italy

[21] Appl. No.: 816,635

[22] Filed: Mar. 13, 1997

[51] Int. Cl.[6] ..... B65B 11/42; B65B 49/14

[52] U.S. Cl. ..... 53/466; 53/228

[58] Field of Search ..... 53/466, 228, 230, 53/233, 464, 220, 226

[56] References Cited

U.S. PATENT DOCUMENTS 3,127,722 4/1964 Schoder ..... 53/230
3,507,089 4/1970 Mizelle et al. ..... 53/230 X
4,574,562 3/1986 Cavazza ..... 53/228 X
5,461,841 10/1995 Spada et al. ..... 53/228 X
5,647,190 7/1997 Minarelli et al. ..... 53/228 X

*Primary Examiner*—Horace M. Culver

[57] ABSTRACT

A method of overwrapping products in sheets of wrapping material, whereby a product, traveling continuously along a path with a respective lateral surface perpendicular at all times to a traveling direction, is wrapped in a respective sheet, which forms about the product a tubular wrapping; and the product is engaged at the ends by a gripping device, which is moved continuously along the path and is maintained constantly in a gripping position contacting surfaces of the product parallel to the traveling direction throughout the formation of the tubular wrapping.

12 Claims, 9 Drawing Sheets

26
60
54
16
P1
21
61
58
59
30
101
55
56
12
28
44
48
45
43
57
2
17
74
18

PRODUCT OVERWRAPPING METHOD

BACKGROUND OF THE INVENTION

The present invention relates to a product overwrapping method.

The method according to the present invention is particularly advantageous for use on continuous overwrapping machines, such as continuous cellophaning machines for tobacco products such as packets or cartons of cigarettes, to which the following description refers purely by way of example.

Though specific reference is made in the following description to the use of sheets of thermoplastic or heat-seal wrapping material, use may obviously also be made of sheets of other material, portions of which may be gummed or otherwise secured by means of operations equivalent to sealing.

As described, for example, in GB Patent 1,134,500, continuous cellophaning machines are known to overwrap packets in sheets of thermoplastic material by feeding the packets successively along a given path, and performing, at successive points along the path, a first wrapping operation wherein each sheet is folded into a U about a respective packet; a second wrapping operation wherein the sheet is further folded to form about the respective packet a tubular wrapping open at each end; a first stabilizing operation wherein the tubular wrapping is sealed longitudinally; a third wrapping operation wherein the open ends of the tubular wrapping are folded onto the packet; and a final stabilizing operation wherein the folded ends of the tubular wrapping are sealed.

On known continuous cellophaning machines, the second of the above wrapping operations, i.e. to close the tubular wrapping laterally, is performed by transferring the packets and respective sheets between two conveyor wheels.

When the cellophaning machine is operated at an output speed of over 600–700 packets a minute, the above method poses serious drawbacks resulting in unacceptable distortion of the overwrappings, especially when working with very thin sheets in the region of 10–15 micron. Which drawbacks are mainly due to the above method failing to provide for constant control of the packets when forming the respective tubular wrappings.

SUMMARY OF THE INVENTION

It is an object of the present invention to provide a product overwrapping method designed to eliminate the aforementioned drawback.

According to the present invention, there is provided a method of overwrapping products in sheets of wrapping material, the method comprising the steps of feeding the products successively along a given path, and performing, at successive points along said path, a first wrapping operation wherein each sheet is folded into a U about a respective said product; a second wrapping operation wherein the sheet is further folded to form about the respective product a tubular wrapping with open ends; a first stabilizing operation wherein the tubular wrapping is closed by means of a longitudinal joint; a third wrapping operation wherein said open ends are folded onto the product; and a second stabilizing operation wherein said folded ends are secured by means of an end joint; the method being characterized in that said first and second wrapping operations are performed while retaining each product via gripping means, which are maintained constantly in a gripping position on the product throughout the performance of said first and second wrapping operations.

In the above method, each product is preferably fed along said path continuously and in a traveling direction substantially perpendicular at all times to a lateral surface of the product.

According to a preferred embodiment of the above method, said first and second wrapping operations are performed while end retaining the products, via said gripping means, at end surfaces of the product parallel to said traveling direction.

Said products are also preferably end retained by said gripping means during the performance of said first stabilizing step.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
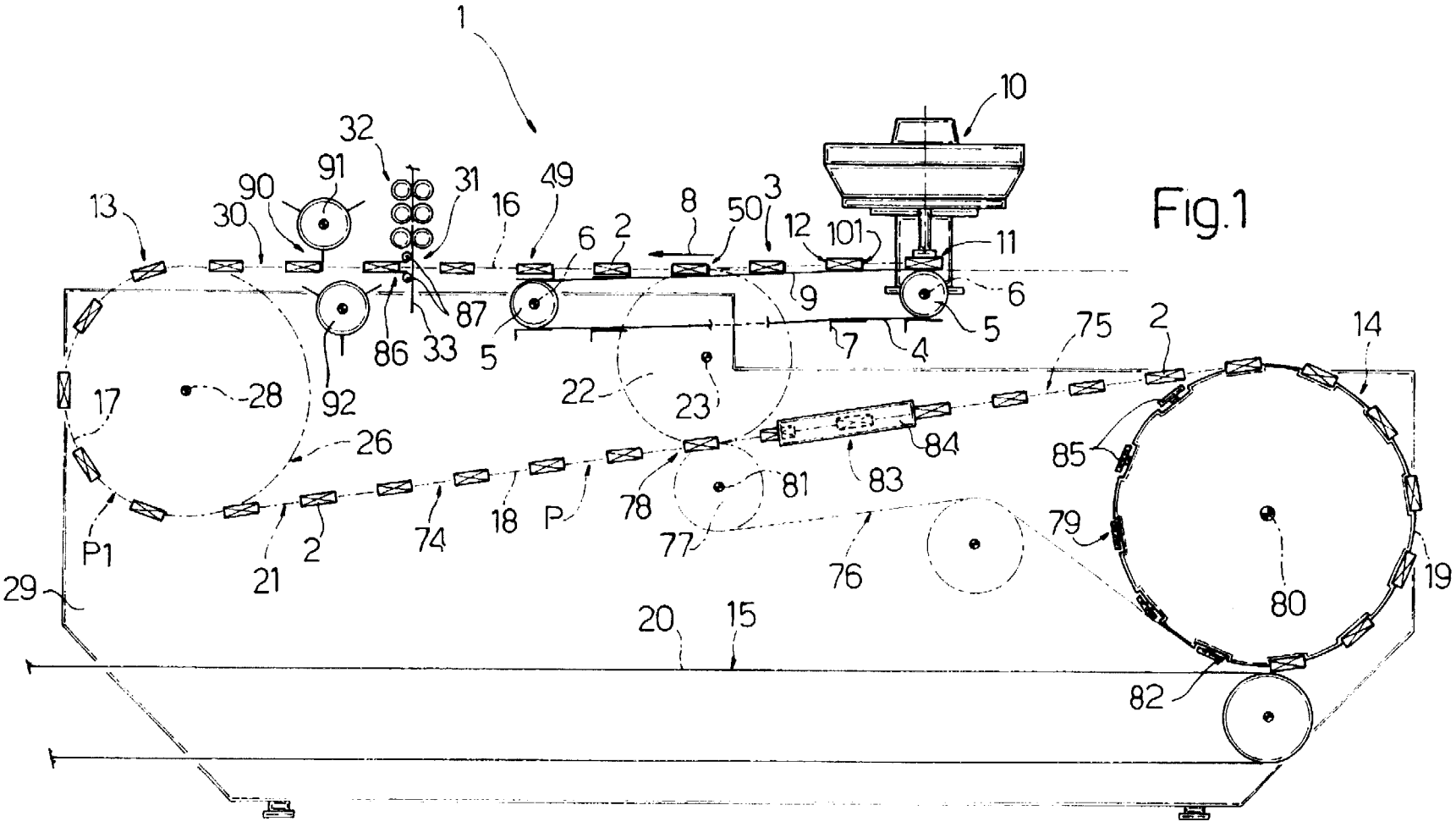
FIG. 1 shows a schematic side view, with parts removed for clarity, of a continuous cellophaning machine implementing the method according to the present invention.
Figure 2:
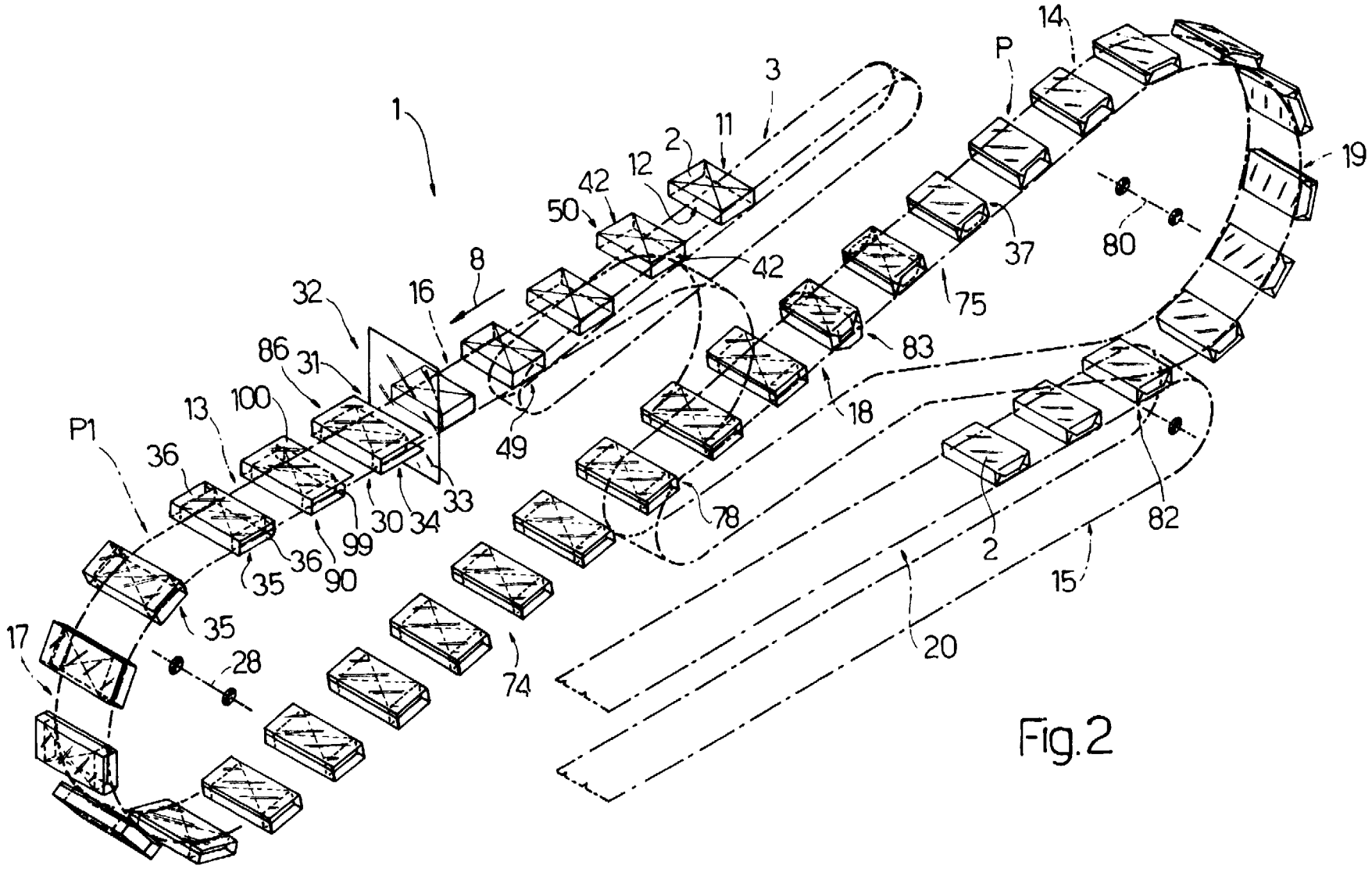
FIG. 2 shows a schematic view in perspective of the succession of operations performed on the FIG. 1 machine.
Figure 3:
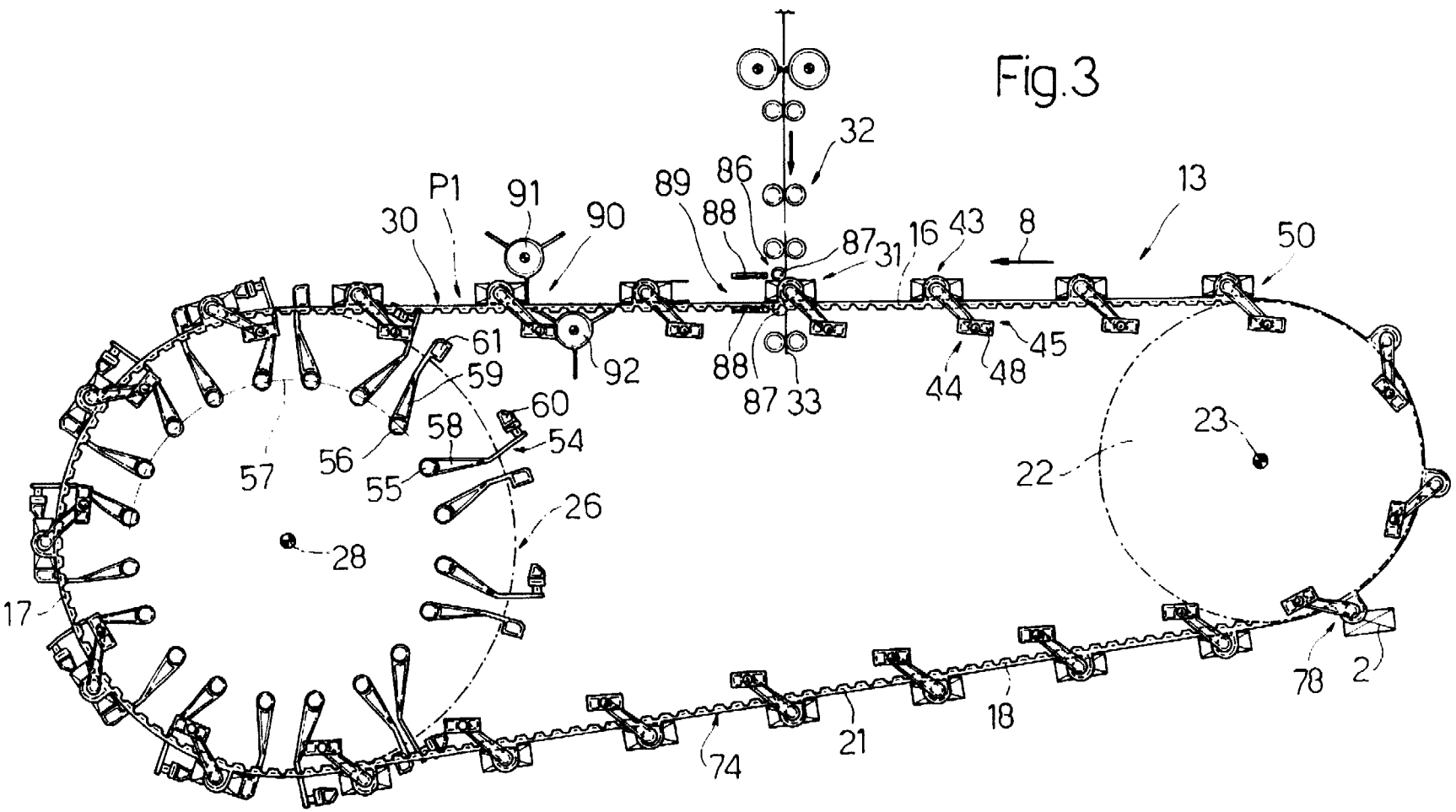
FIG. 3 shows a larger-scale schematic side view of a first detail in FIG. 1.

Number 1 in FIG. 1 indicates a continuous cellophaning machine for packets 2 of cigarettes. Machine 1 comprises an input conveyor 3 defined by a belt 4 looped about two pulleys 5 (one of which is powered) mounted for rotation about respective substantially horizontal axes 6 parallel to each other. Belt 4 comprises a number of transverse projections 7 parallel to axes 6 and defining, with adjacent projections 7, a number of conveying pockets, each of which is of a length—measured in the traveling direction 8 of the upper conveying branch 9 of belt 4—greater than the width of packets 2, and of a width substantially equal to the length of packets 2. Each pocket along the conveying branch 9 of belt 4 receives, from a rotary turret conveyor 10 at a loading station 11, a respective packet 2 laid flat and oriented with a small longitudinal lateral surface 12 facing forwards in direction 8 and substantially perpendicular to direction 8.

Machine 1 also comprises a first wrapping conveyor 13, a second wrapping conveyor 14, and an output conveyor 15, which are arranged in series and connected to one another to define, with input conveyor 3, a substantially S-shaped path P along which packets 2 are fed.

More specifically, path P comprises, in series and as of station 11, a first substantially straight portion 16 defined by conveyor 3 and by an input portion of conveyor 13; a first curved portion 17 defined by a curved portion of conveyor 13; a second straight portion 18 facing portion 16 to define, with portions 16 and 17, a substantially U-shaped path P1, and comprising an output portion of conveyor 13 and an input portion of conveyor 14; a second curved portion 19 defined by a curved portion of conveyor 14; and a third straight portion 20 defined by output conveyor 15 and facing portions 16 and 18.

Figure 8:
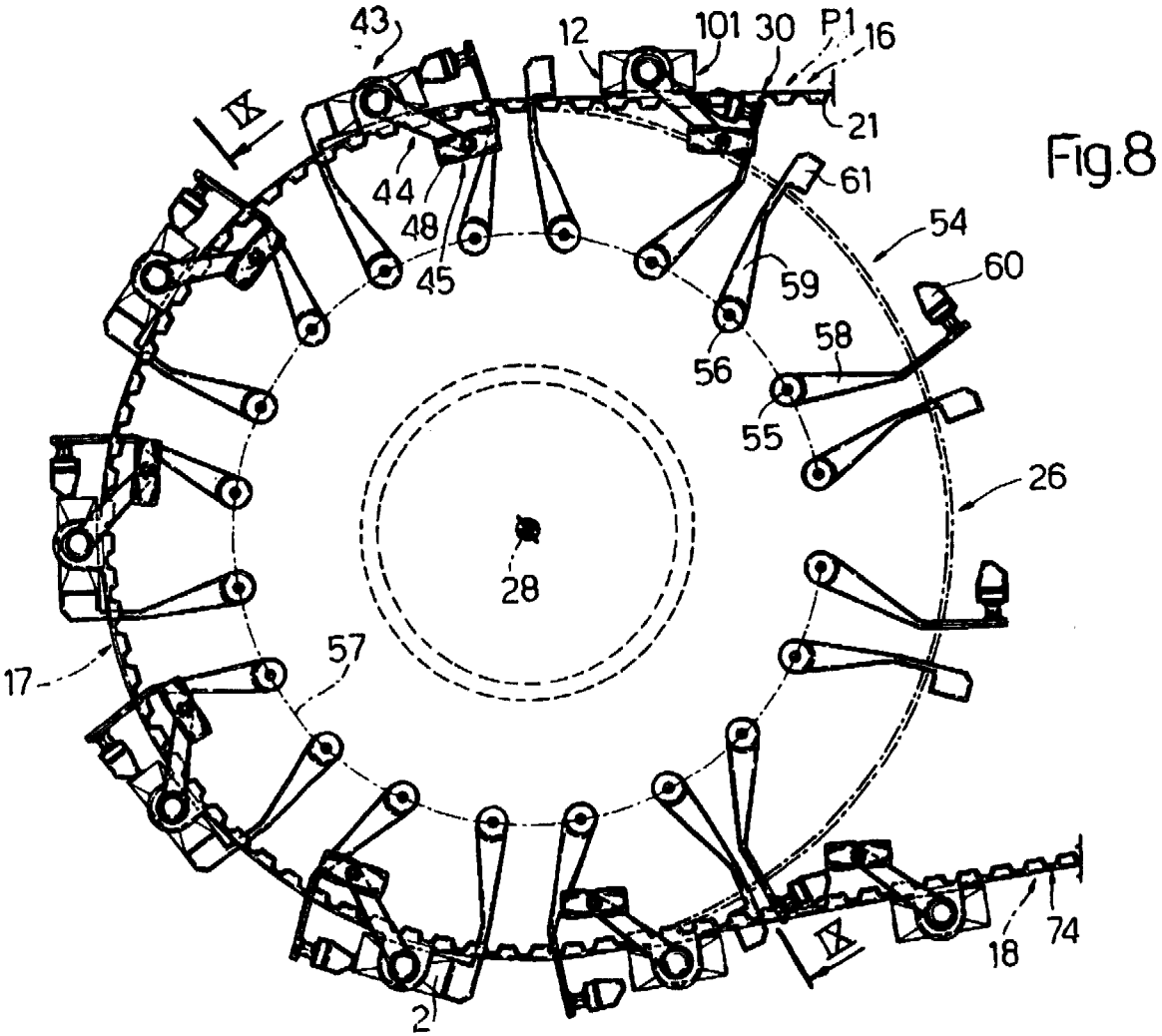
FIG. 8 shows a larger-scale view of a further detail in FIG. 3.
Figure 9:
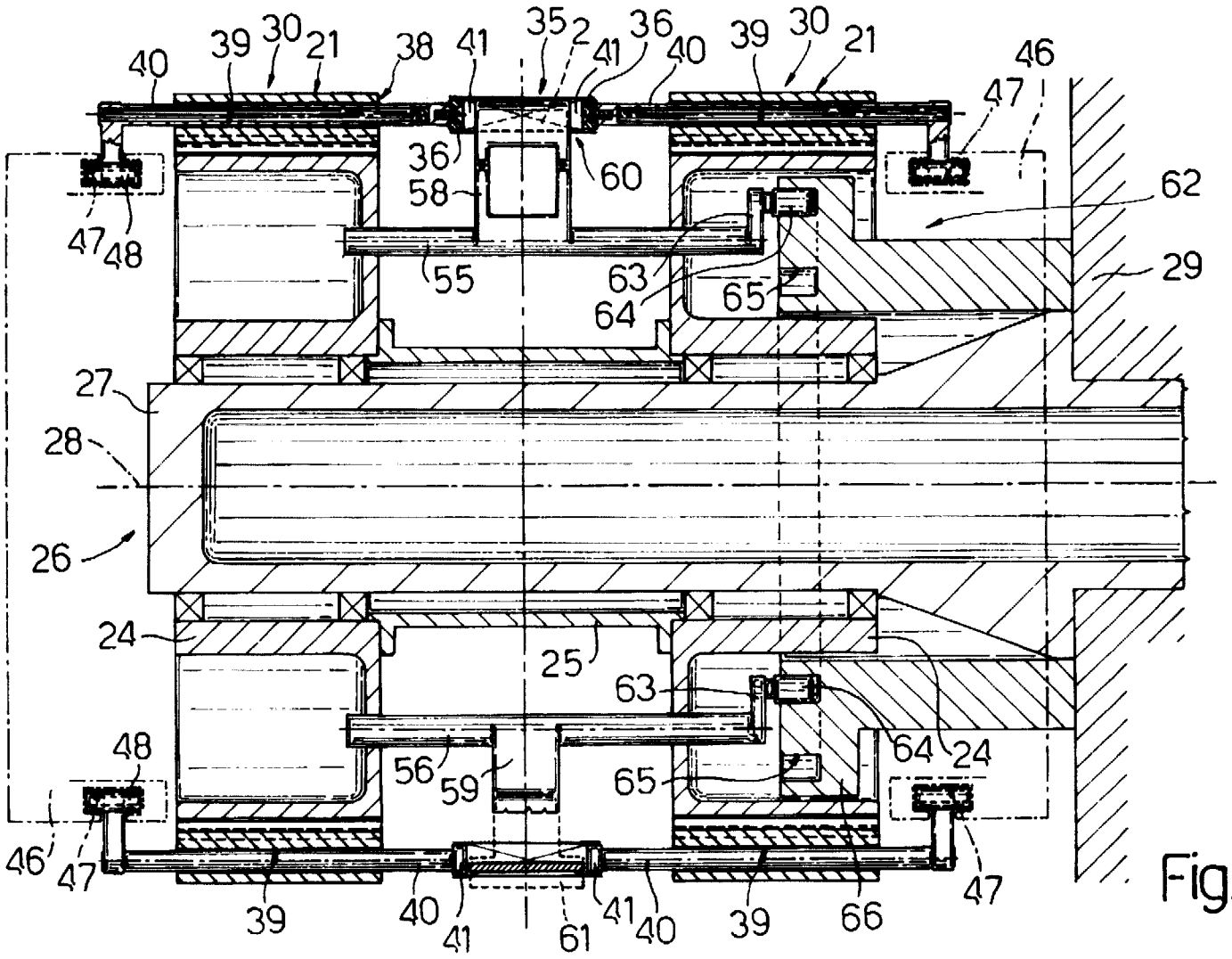
FIG. 9 shows a section along line IX—IX in FIG. 8.

As shown clearly in FIGS. 3, 6, 8 and 9, conveyor 13 comprises two parallel, internally-toothed belts 21, each of which is looped about a respective pair of toothed pulleys. More specifically, each belt 21 is connected to a respective powered input pulley 22—intergral with pulley 22 of the other belt 21 and mounted for rotation about a respective axis 23 parallel to axes 6—and to a respective disk 24, which, as shown in FIG. 9, is made integral with the other disk 24 by a central sleeve 25 to define a cylindrical drum 26. The portion of the outer periphery of drum 26 contacting belts 21 defines curved portion 17 of paths P and P1, and drum 26 is fitted idly to a shaft 27 having an axis 28 parallel to axis 23, and which is supported, together with pulleys 22 and 5, on a fixed frame 29.

Belts 21 comprise a substantially straight upper branch 30 defining an output portion of straight portion 16 of paths P and P1, and extending, at a loading station 31, through a known line 32 for supplying a succession of sheets 33 of wrapping material, each of which is folded about a respective packet 2 to form, firstly, a U-shaped wrapping 34, and, secondly, a tubular wrapping 35, the opposite axial ends 36 of which project from the corresponding ends of respective packet 2, and are subsequently folded to form a closed wrapping 37. At station 31, each sheet 33 is perpendicular to belts 21, which are so spaced as to define a channel 38 wider than sheets 33.

Figure 6:
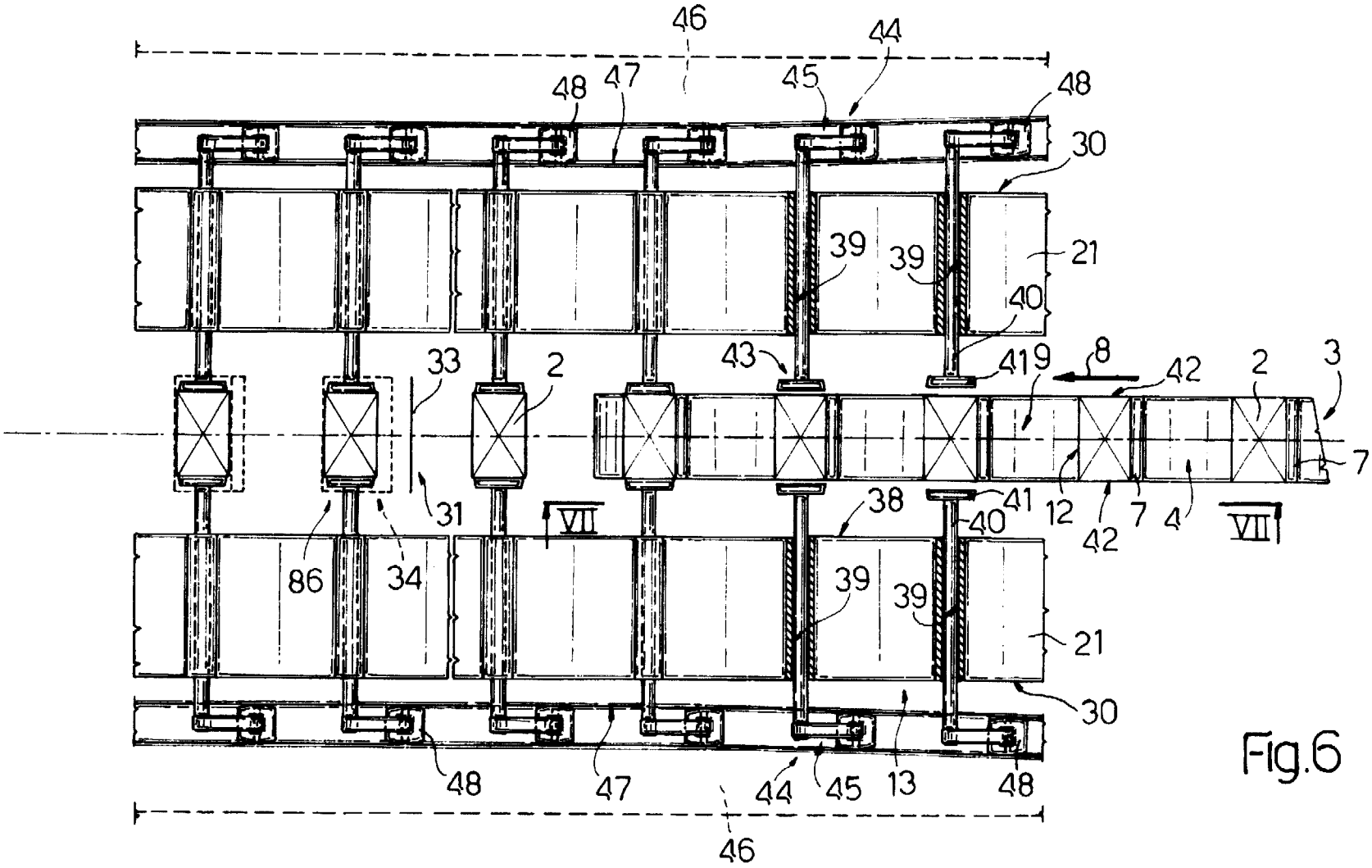
FIG. 6 shows a larger-scale schematic plan view of a second detail in FIG. 1.

As shown clearly in FIG. 6, each belt 21 comprises a number of through holes 39 formed in the thickness of belt 21, extending parallel to axes 6, and equally spaced along belt 21 with the same spacing as projections 7. Each hole 39 houses in axially-sliding manner a rod 40 coaxial with a corresponding rod 40 on the other belt 21, and fitted on its free end, inside channel 38, with a pad 41 of a transverse size approximately equal to but no larger than an axial end surface 42 of packet 2 extending parallel to direction 8.

Each pair of corresponding rods 40 and respective pads 41 define a gripping device 43 of a gripping assembly 44, and the axial position of rods 40 and pads 41 with respect to respective belt 21 is controlled by control means comprising a cam actuating device 45 forming part of assembly 44 and comprising, for each belt 21, a plate 46 perpendicular to axes 23 and 28 and of the same shape as belt 21. Each plate 46 is located on the opposite side of respective belt 21 to the other belt 21, and comprises a respective peripheral track 47, which is engaged by a number of slides 48, each connected to the opposite end of a respective rod 40 to that fitted with respective pad 41, and curves crosswise to direction 8 to move pads 41 to and from a gripping position in which pads 41 of each device 43 are separated by a minimum distance approximately equal to but no greater than the length of packets 2 measured perpendicularly to surfaces 42.

Figure 7:
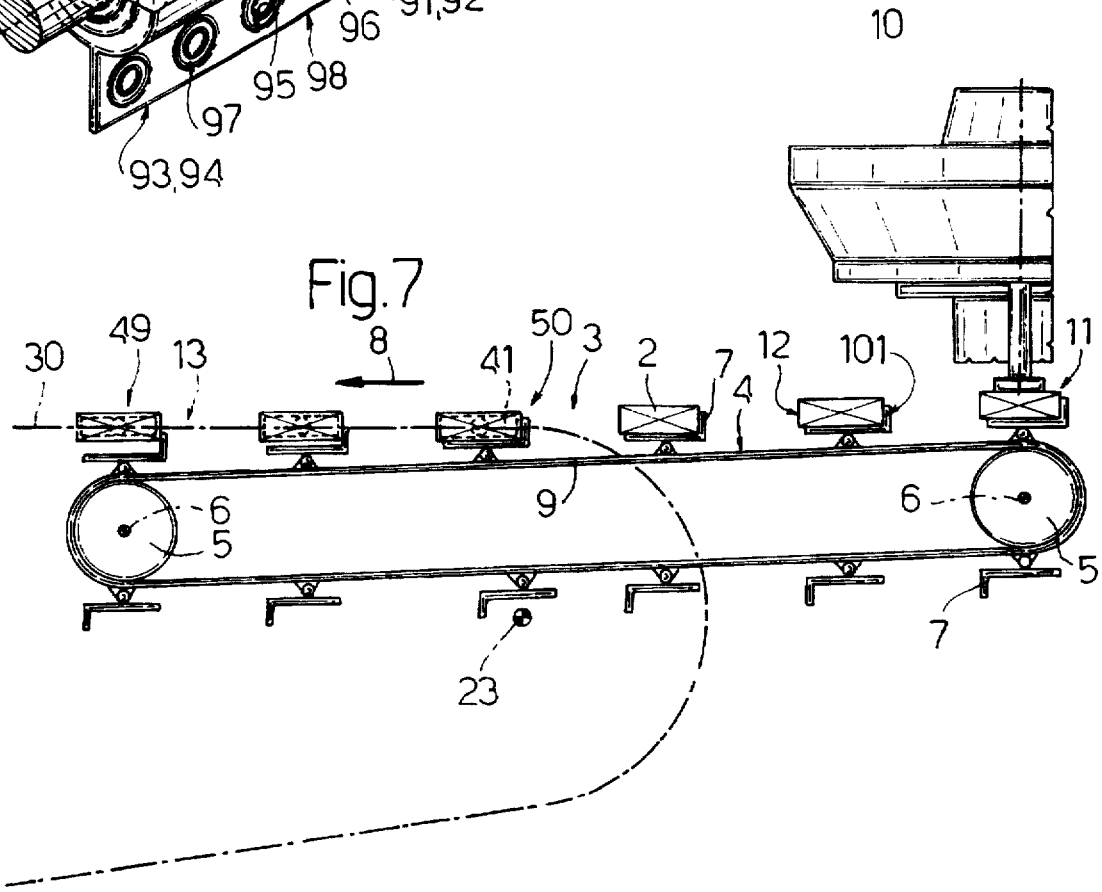
FIG. 7 shows a section along line VII—VII in FIG. 6.

With reference to FIGS. 1, 6 and 7, input conveyor 3 comprises an output portion extending between belts 21 along channel 38 and, as shown in FIG. 7, sloping downwards with respect to branch 30 of belts 21, with projections 7 perpendicular to the surface of branch 30. The downward slope of conveyor 3 is such that packets 2, on contacting the surface of branch 30, are detached from projections 7 at a transfer station 49 located downstream, in direction 8, from a gripping station 50 where pads 41 of each device 43 are set to the gripping position.

Figure 10:
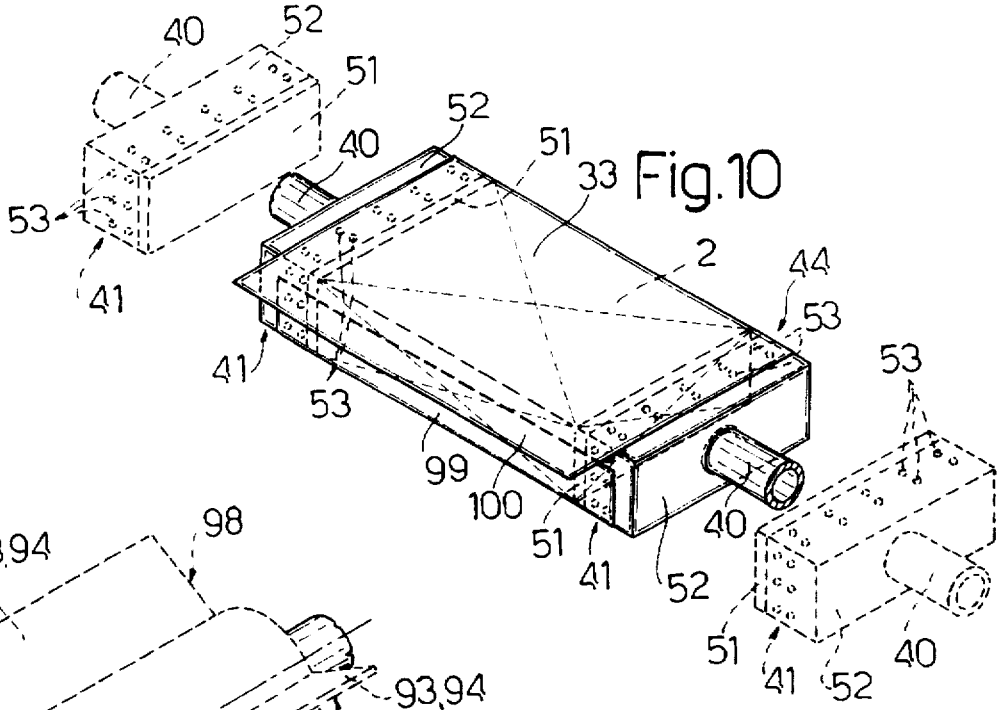
FIG. 10 shows a larger-scale view in perspective of a variation of a detail in FIG. 6.

To prevent damaging packets 2, each pad 41 comprises a deformable end element 51, which may be fitted directly to the free end of respective rod 40, or, as shown in the FIG. 10 variation, may be connected to a hollow body 52 interposed between rod 40 and element 51 and having external suction holes 53.

As shown particularly in FIG. 8, each device 43 is associated on drum 26 with a sealing device 54 comprising two shafts 55 and 56 parallel to axis 28 and mounted for rotation between disks 24 preferably, but not necessarily, along a circumference 57. Shafts 55 and 56 are fitted with respective radial arms 58 and 59 located between disks 24 and projecting outwards of belts 21. At the arc traveled by pads 41 about axis 28, arms 58 and 59 are fitted respectively with a sealing device 60 facing in the traveling direction 8 of packets 2, and a pad 61 facing respective sealing device 60. Shafts 55 and 56 of each device 54 are rotated in opposite directions by an actuating device 62 (FIG. 9) comprising two square levers 63, which are connected to the ends of shafts 55 and 56 facing frame 29, and comprise respective tappet rollers 64 engaging in rolling manner respective tracks 65 formed on the face of an annular cam 66 fitted in a fixed position to frame 29.

Figure 11:
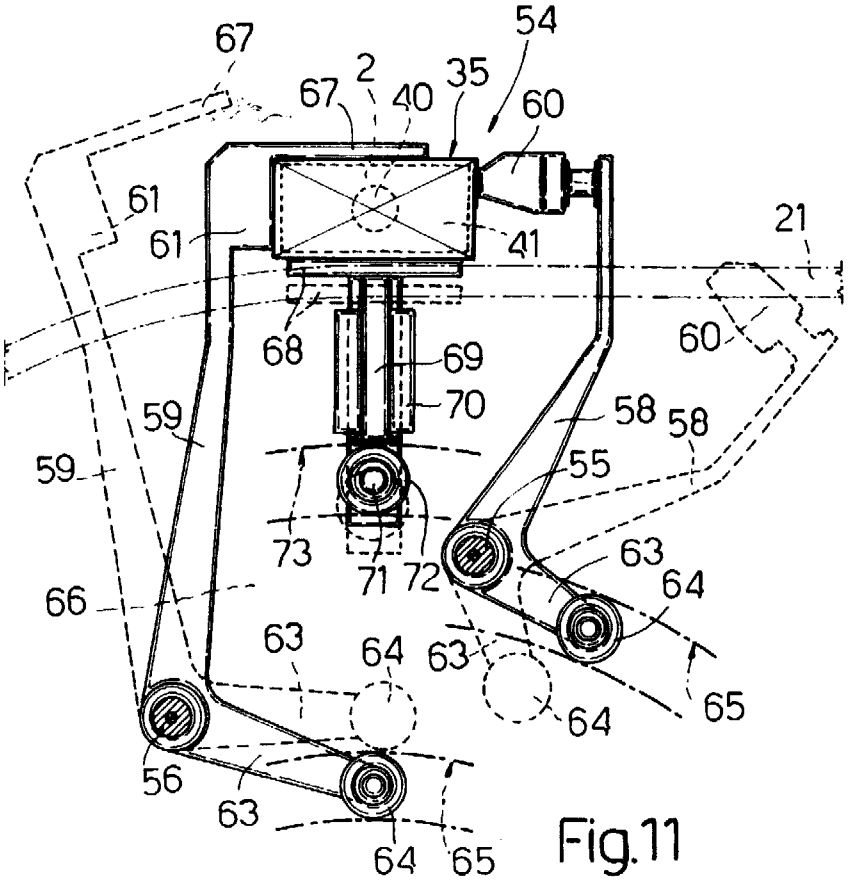
FIG. 11 shows a larger-scale schematic side view of a variation of a first detail in FIG. 8.

In the FIG. 11 variation, each pad 61 comprises a tooth 67, which extends parallel to the outer periphery of drum 26 towards respective sealing device 60, and is located outwards of the arc traveled by pads 41 about axis 28; and each tooth 67 is located radially outwards of a radial thrust pad 68 located between disks 24 and fitted integrally to one end of a radial rod 69. Rod 69 is fitted in sliding manner inside a radial guide 70 fitted to disks 24, and comprises, on the end opposite that fitted with pad 68, a transverse pin 71 supporting for rotation a tappet roller 72 engaging in rolling manner a respective track 73 of cam 66.

As shown in FIG. 1, belts 21 comprise a lower branch 74 facing branch 30 and coaxial with the upper branch 75 of a belt 76 of conveyor 14. Belt 76 comprises projections similar to belt 4, and is looped about a pulley 77 located between belts 21 at a transfer station 78, and about a powered sealing drum 79 rotating about an axis 80 parallel to axis 6 and to the axis 81 of rotation of pulley 77. Branches 74 and 75 define straight portion 18 of paths P and P1, and the periphery of drum 79 defines curved portion 19 of path P and is tangent to output conveyor 15 at a transfer station 82.

Branch 75 extends through a folding station 83 defined by a known folding device 84 for folding ends 36 of wrappings 35 to form respective wrappings 37; and drum 79 is fitted with pairs of known end sealing devices 85 for stabilizing the folded ends 36 of wrappings 37.

No further description is given herein of conveyor 14, which forms the object of U.S. Pat. No. 5,477,661, to which full reference is made herein in the interest of full disclosure.

Figure 4:
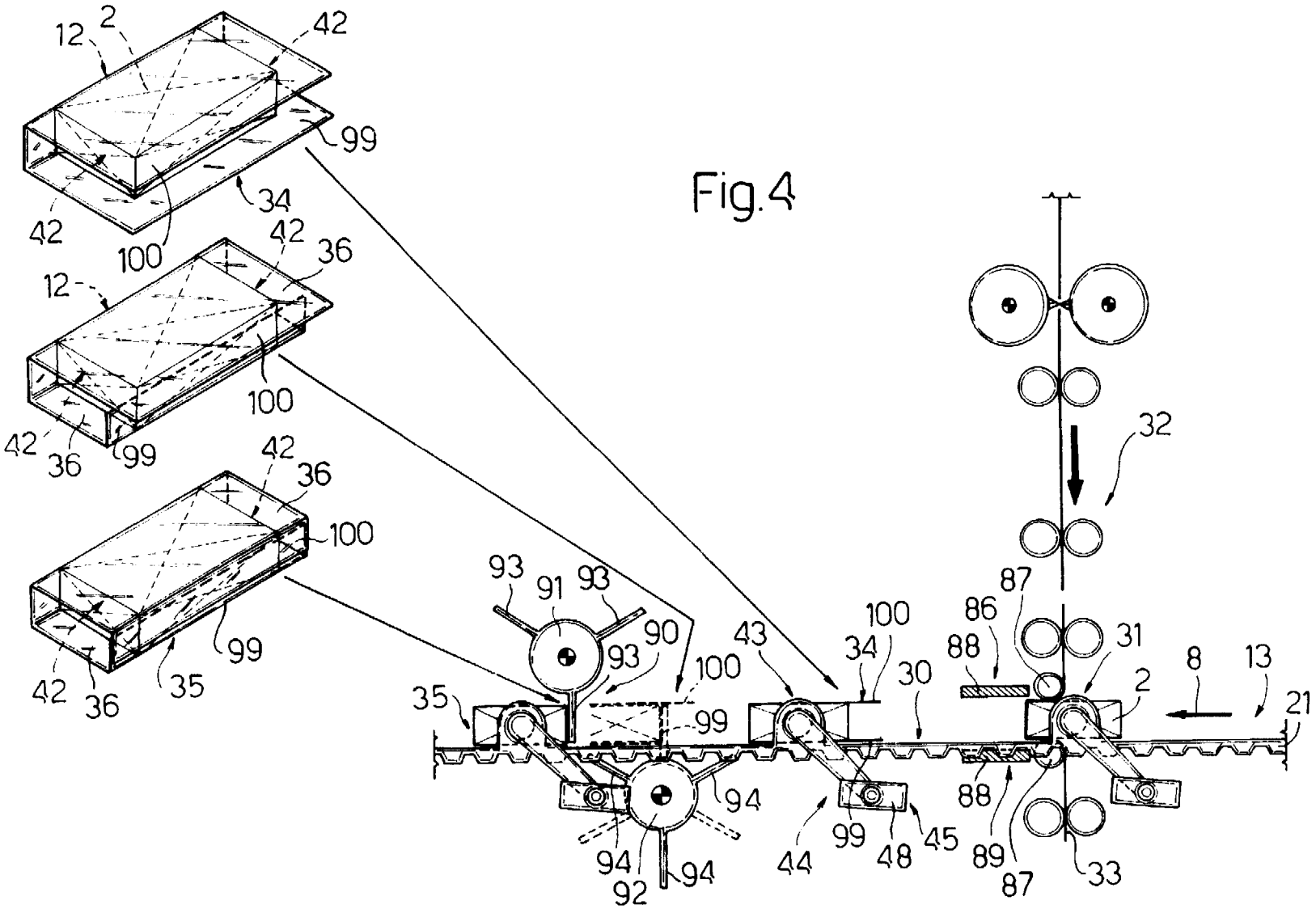
FIG. 4 shows a larger-scale view of a first detail in FIG. 3.

As shown particularly in FIG. 4, upper branch 30 of belts 21 extends through a folding station 86 located immediately downstream from loading station 31 in direction 8, and defined by two rollers 87 parallel to axis 6 and fitted one over the other to frame 29. Rollers 87 define a passage located along path P and of a width approximately equal to but no smaller than the thickness of packet 2 measured perpendicularly to branch 30 and to direction 8. Station 86 also comprises two plates 88 defining the plates of a capacitor 89 and located immediately downstream from rollers 87 in direction 8, and respectively above and below path P to define, with rollers 87, a channel for the passage of packets 2.

As shown particularly in FIG. 4, upper branch 30 of belts 21 extends through a further folding station 90 located along straight portion 16 of paths P and P1, downstream from station 86 in direction 8, and defined by two rollers 91 and 92 parallel to axis 6 and fitted one over the other to frame 29. Rollers 91 and 92 comprise respective radial appendixes 93 and 94 extending longitudinally along the outer periphery of rollers 91 and 92, and defining respective movable folding elements, which intersect paths P and P1 to fold each sheet 33 onto a surface of respective packet 2 opposite surface 12.

Figure 5:
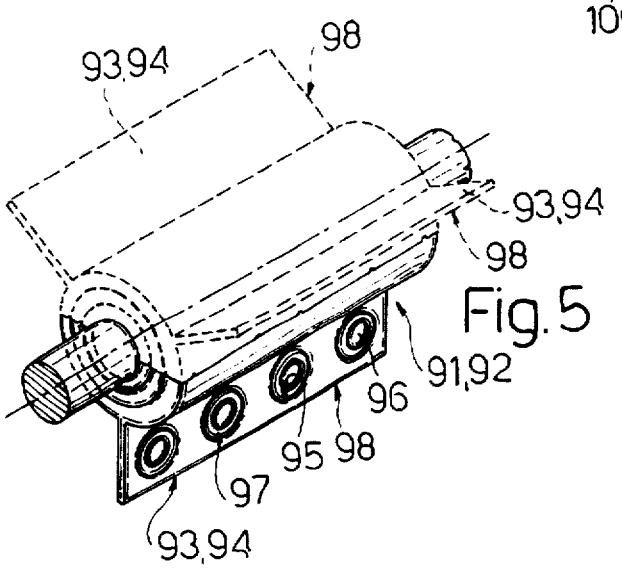
FIG. 5 shows a larger-scale view in perspective of a second detail in FIG. 3.

As shown in FIG. 5, each appendix 93, 94 is made of metal, and comprises circular holes 95 housing respective metal inserts 96 via the interposition of respective annular insulating elements 97; and each insert 96 defines, with respective appendix 93, 94, the plates of a multiple capacitor 98.

The operations performed on each packet 2 by machine 1 will now be described as of the instant in which conveyor 10 releases packet 2 contacting a respective projection 7 of conveyor 3 at loading station 11

Traveling at constant speed along branch 9 of conveyor 3 in direction 8, packet 2 enters channel 38 defined by belts 21 of conveyor 13, and is gradually lowered until surfaces 42 of packet 2 are gripped by pads 41 of respective gripping device 43. For a given distance downstream from station 50 and up to station 49, packet 2 is conveyed simultaneously by conveyors 4 and 13 traveling in direction 8 at the same speed, and subsequently remains connected, by means of respective gripping device 43, to conveyor 13 only, by which it is fed at constant speed through folding station 86.

At station 86, packet 2 intercepts a respective sheet 33 supplied by line 32, and feeds sheet 33 through the passage defined by the two rollers 87 and two plates 88 of capacitor 89, so that sheet 33 is folded into a U-shaped wrapping 34 about packet 2. More specifically, sheet 33 is folded with a central portion contacting surface 12 of packet 2, with two end portions contacting the top and bottom surfaces of packet 2, and with two projecting end portions 99 and 100 extending rearwards from a lateral surface 101 of packet 2 opposite surface 12.

As sheet 33 travels between plates 88 of capacitor 89, electric charges are induced on sheet 33, and which correspond to electric charges of opposite sign on the surfaces of packet 2, the outer wrapping of which is made of dielectric material. Sheet 33 thus adheres firmly, in the U-folded configuration, to packet 2 by electrostatic attraction, and may safely be supplied to folding station 90, where portion 99 is folded by roller 92 onto surface 101, and portion 100 is folded by roller 91 onto surface 101 and partly over portion 99. By the end of this further folding operation, which is performed as packet 2 travels along straight portion 16 of paths P and P1, thus ensuring a highly precise fold, sheet 33 is fully folded about packet 2 to form a tubular wrapping 35, which is formed without gripping device 43 ever having to release packet 2.

Also when folding portions 99 and 100, firm adherence of portions 99 and 100 to packet 2 and to each other is ensured by electric charges induced on portions 99 and 100 and on surface 101 by capacitors 98 on appendixes 93 and 94 of rollers 91 and 92. The electric charges induced by capacitors 89 and 98 ensure sheet 33 adheres firmly to packet 2 throughout the formation of tubular wrapping 35. Should appendixes 93 and 94 be straightforward folding devices, the position of sheet 33 on packet 2 during the formation of tubular wrapping 35 may be controlled using pads 41 of the type shown in FIG. 10.

As it travels along curved portion 17 of paths P and P1, wrapping 35 is stabilized by connecting portions 99 and 100 by means of a longitudinal seal made by gripping packet 2 between respective sealing device 60 and respective pad 61, which provides for counterbalancing the pressure exerted by sealing device 60 when sealing portions 99 and 100.

Wrapping 35 is preferably stabilized using sealing device 54 in FIG. 11, wherein pad 68 and tooth 67 of pad 61 prevent the top and bottom walls of packet 2 from swelling outwards under the transverse pressure exerted by sealing device 60 and pad 61.

Once enclosed in respective wrapping 35, packet 2 is fed to station 83, where ends 36 are folded in known manner to form a closed wrapping 37, which is stabilized by sealing devices 85 as packet 2 travels along curved portion 19 of path P.

Figure 12:
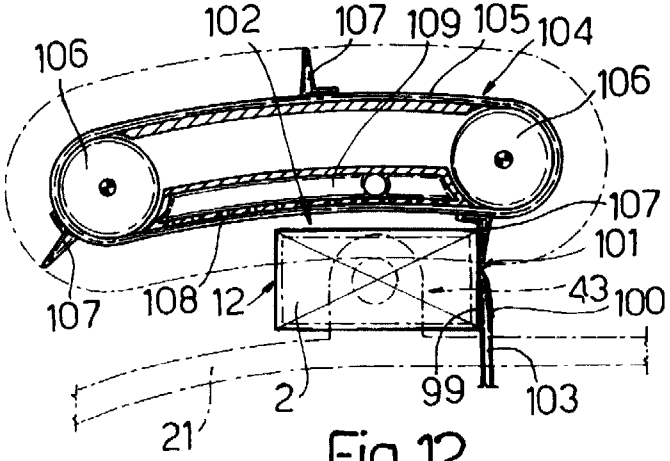
FIGS. 12 and 13 show larger-scale schematic side views of a variation of a second detail in FIG. 8 in two different operating positions.
Figure 13:
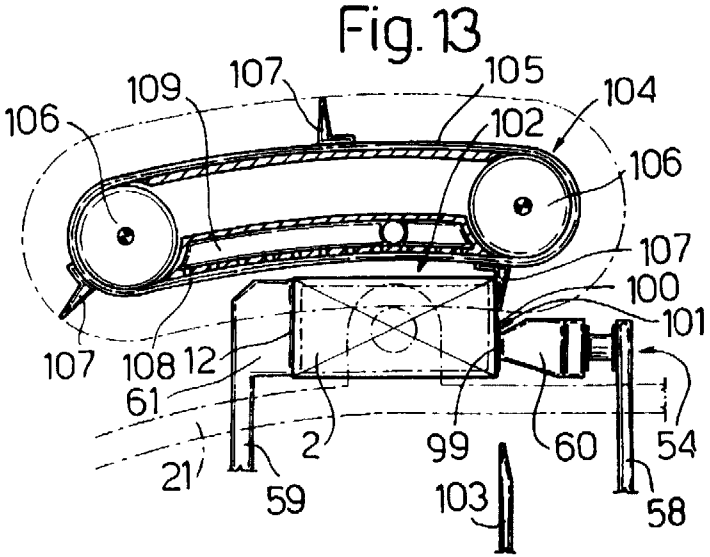

In the variation shown in FIGS. 12 and 13, folding station 90 and rollers 91 and 92 in FIG. 1 are replaced by a folding station 102 located along curved portion 17 of paths P and P1. At station 102, inner portion 99 of each wrapping 34 is folded onto surface 101 of respective packet 2 by a known folding device 103 fitted to drum 26 at a respective sealing device 54, and movable, with respect to drum 26 and by virtue of a known actuating device preferably activated by cam 66 by means of a further track (not shown), to and from a forward position in which folding device 103 interferes with path P1 to press portion 99 onto surface 101 of packet 2. As shown in FIG. 12, portion 100, on the other hand, is folded onto surface 101 by a folding device 104 comprising a belt 105 looped about two pulleys 106 —one of which is powered —to travel at the same speed as belts 21. Belt 105 is fitted with a number of folding elements 107, and comprises a branch 108 extending outside drum 26, traveling in the same direction as belts 21, and maintained parallel to belts 21 by a suction device 109 to feed a folding element 107 through station 102 in time with a respective packet 2, and in such a position as to engage and fold portion 100 of respective wrapping 34 onto surface 101 of packet 2 and partly onto portion 99.

In actual use, portion 99 is first folded onto surface 101 by folding device 103; and folding element 107 then folds portion 100 squarely onto surface 101 and partly over folding device 103, which at this point is withdrawn to free portion 99 and enable sealing device 60 to seal the superimposed portion of portions 99 and 100.

I claim:

1. A method of overwrapping products (2) in sheets (33) of wrapping material, the method comprising the steps of feeding the products (2) successively along a given path (P), and performing, at successive points along said path (P), a first wrapping operation wherein each sheet (33) is folded into a U about a respective said product (2); a second wrapping operation wherein the sheet (33) is further folded to form about the respective product (2) a tubular wrapping (35) with open ends (36); a first stabilizing operation wherein the tubular wrapping (35) is closed by means of a longitudinal joint; a third wrapping operation wherein said open ends (36) are folded onto the product (2); and a second stabilizing operation wherein said folded ends (36) are secured by means of an end joint; the method being characterized in that said first and second wrapping operations are performed while retaining each product (2) via gripping means (43), which are maintained constantly in a gripping position on the product (2) throughout the performance of said first and second wrapping operations.

2. A method as claimed in claim 1, characterized in that each product (2) is fed along said path (P) continuously and in a traveling direction (8) substantially perpendicular at all times to a lateral surface (12) of the product (2).

3. A method as claimed in claim 1, characterized in that said first and second wrapping operations are performed while end retaining the products (2), via said gripping means (43), at end surfaces (42) of the product (2) parallel to said traveling direction (8).

4. A method as claimed in claim 1, characterized in that said products (2) are also retained by said gripping means (43) during the performance of said first stabilizing step.

5. A method as claimed in claim 1, characterized in that said path (P) comprises straight portions (16, 18, 20) and curved portions (17, 19); at least said first wrapping operation being performed as the products (2) travel along a said straight portion (16).

6. A method as claimed in claim 5, characterized in that at least said first and second wrapping operations are performed as the products (2) travel along a said straight portion (16).

7. A method as claimed in claim 6, characterized in that said path (P) comprises straight portions (16, 18, 20) and curved portions (17, 19); said wrapping operations being performed as the products (2) travel along straight portions of said path (P).

8. A method as claimed in claim 1, characterized in that said path (P) comprises straight portions (16, 18, 20) and curved portions (17, 19); said wrapping operations being performed as the products (2) travel along a portion (Pl) of said path (P) comprising only one curved portion (17).

9. A method as claimed in claim 8, characterized in that said portion (P1) of said path (P) is a U-shaped portion comprising a first (16) and second (18) straight portion connected to each other by a curved portion (17).

10. A method as claimed in claim 1, characterized in that said path (P) comprises straight portions (16, 18, 20) and curved portions (17, 19); at least said first and second wrapping operations being performed as the products (2) travel along at least part of said straight portions (16, 18, 20), and said stabilizing operations being performed as the products (2) travel along at least part of said curved portions (17, 19).

11. A method as claimed in claim 1, characterized in that at least one of said first and second wrapping operations is performed in the presence of an electric field.

12. A method as claimed in claim 1, characterized in that said sheets (33) of wrapping material comprise thermoplastic material; said stabilizing operations being sealing operations.

* * * * *

UNITED STATES PATENT AND TRADEMARK OFFICE

CERTIFICATE OF CORRECTION

PATENT NO. : 5,794,413

DATED : August 18, 1998

INVENTOR(S) : Fiorenzo Draghetti

It is certified that error appears in the above-indentified patent and that said Letters Patent is hereby corrected as shown below:

On title page, add -- [30] Foreign Application Priority Data

March 15, 1996 [IT] Italy BO96A 000139.--

Signed and Sealed this

Twenty-fourth Day of November, 1998

*Attest:*

*Attesting Officer*

BRUCE LEHMAN

*Commissioner of Patents and Trademarks*